United States Patent [19]

Farmer

[11] 4,137,626

[45] Feb. 6, 1979

[54] REPAIR OF ARMATURE COMMUTATOR

[76] Inventor: Cecil Farmer, Lake Belair, North Smithfield, R.I. 02895

[21] Appl. No.: 877,187

[22] Filed: Feb. 13, 1978

Related U.S. Application Data

[60] Continuation-in-part of Ser. No. 799,371, May 23, 1977, abandoned, which is a division of Ser. No. 692,670, Jun. 4, 1976, abandoned, which is a continuation-in-part of Ser. No. 593,325, Jul. 7, 1975, abandoned.

[51] Int. Cl.[2] ..... H01R 43/06

[52] U.S. Cl. ..... 29/597; 29/401 B; 29/401 F

[58] Field of Search ..... 29/597, 401 B, 401 D, 29/401 F; 310/4 L, 233–236

[56] References Cited

U.S. PATENT DOCUMENTS 3,519,863 7/1970 Ambler et al. ..... 29/597 X 3,911,548 10/1975 Perry ..... 29/401 D

*Primary Examiner*—Carl E. Hall

*Attorney, Agent, or Firm*—Barlow & Barlow

[57] ABSTRACT

This rotary armature of an electric motor or the like is provided with a commutator which has a number of segments, each of which has a brush-engaging portion and a riser portion to which riser portions the wires of the coils are attached. The brush-engaging portion often becomes worn or chipped especially if attempted to be turned down and the entire brush-engaging portion and risers are removed for replacement which requires unsoldering the coil wires which are led to the riser portions of the commutator segments. This invention relates to the severing of the brush-engaging portion from the riser portion of the commutator and replacing only the brush-engaging segments without the need for unsoldering the wires from each of the coils to the riser portions of the commutator segments.

4 Claims, 15 Drawing Figures

REPAIR OF ARMATURE COMMUTATOR

CROSS REFERENCE TO RELATED APPLICATIONS

This application is a continuation-in-part of my application Ser. No. 799,371, filed May 23, 1977, now abandoned, which is a division of my application Ser. No. 692,670, filed June 4, 1976, now abandoned, which is a continuation-in-part of my earlier filed application Ser. No. 593,325, filed July 7, 1975, now abandoned.

BACKGROUND OF THE INVENTION

Conventional armature construction has a core with slots therein in which slots there are located coils with the wires extending from each of the coils to a section of the commutator. The commutator is generally a molded piece formed with conductive segments having a riser portion to which the coil wires are attached and also a portion with which the brushes of the motor engage. Examples of such types of commutators are illustrated by U.S. Pat. Nos. 2,634,495 and 3,251,120. Frequently, the commutator brush-engaging section needs to be turned down to repair certain portions and in doing so the sections might become chipped which require the replacing of the entire commutator including the brush-engaging portion and the risers which were attached to the wires from each of the coils. This was an expensive and tedious operation.

SUMMARY OF THE INVENTION

This invention relates primarily to the commutator portion of an armature and when it becomes necessary to replace some of the brush-engaging portions or sections of the commutator, instead of removing the entire commutator including the risers which are attached to the wires from the coils, the brush-engaging portion is severed circularly down to the shaft of the armature leaving a stub portion extending from each of the riser sections. Then, a fresh brush-engaging portion cupped to receive the stub portions of the segments from the riser portions is telescoped over these stub sections and electrically connected to each of the sections which are close to the risers, the electrical connection usually being by soldering, and this is a quicker and better operation than unsoldering each of the wires from the coils in the slots of the core of the armature. In accordance with the second embodiment the brush-engaging portion is severed immediately adjacent the riser sections and a fresh brush-engaging portion with thin metallic outwardly turned portions may be slipped over the shaft so that the portions are adjacent to the coil ends on the old risers and then may be easily cross soldered thereto.

In accordance with the third embodiment of the invention, the brush-engaging portion is severed immediately adjacent the riser section, insulation beneath the riser section is removed and a fresh brush-engaging portion is slipped over the shaft with its segments close to or beneath the old risers and then the segments of the new brush-engaging sections are soldered to the corresponding old risers.

DESCRIPTION OF THE PREFERRED EMBODIMENTS

With reference to the drawings 10 designates the armature shaft which extends completely through the armature. The armature core is designated generally 11 and is slotted as seen at 12 into which slots there are coils of wire with the ends of these coils extending as at 13 each to engage one segment of the commutator designated generally 14.

Figure 3:
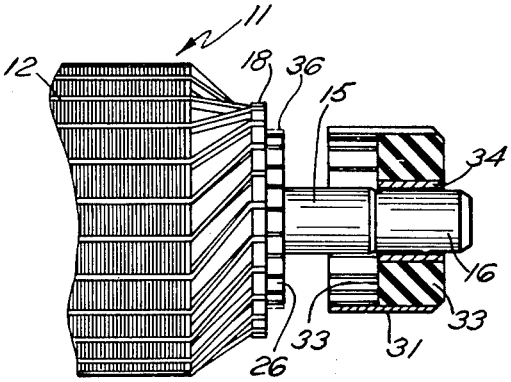
FIG. 3 is a sectional view similar to FIG. 2 but illustrating the replacement unit as being assembled on the shaft of the armature.
Figure 4:
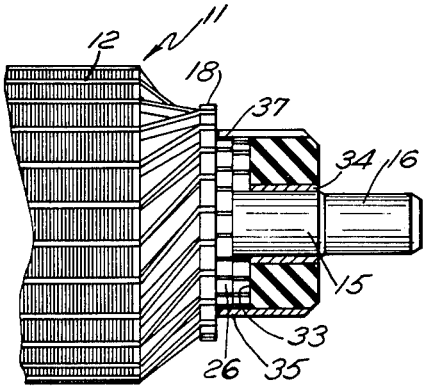
FIG. 4 is a sectional view similar to FIG. 3 showing the replaced unit in position and soldered.

This commutator is mounted on the slightly larger portion of the shaft 10 which is designated 15 in FIG. 3, there being a smaller portion 16 which finds its bearing in the motor housing. The commutator has two portions, one being the brush-engaging portion 17 and the other the riser portion designated 18 which extends at right angles to the brush-engaging portion. The commutator is divided into segments and each segment has a slot in the riser portion into which one of the coil wires are electrically connected. In the usual commutator, the brush-engaging portion and the risers 18 are provided in a plurality of insulated segments designated generally 19 and the segment for the brush-engaging portion and the riser to which the wire is connected is usually all one piece. A typical commutator is shown in U.S. Pat. No. 3,864,821 and is effectively segments on the periphery of an insulating cylinder. Usually a damaged commutator has one of the segments such as shown at 20 chipped off or destroyed beyond repair and in some cases several of these occur and it is necessary to replace in the ordinary operation the entire commutator including brush-engaging and riser portions.

Figure 1:
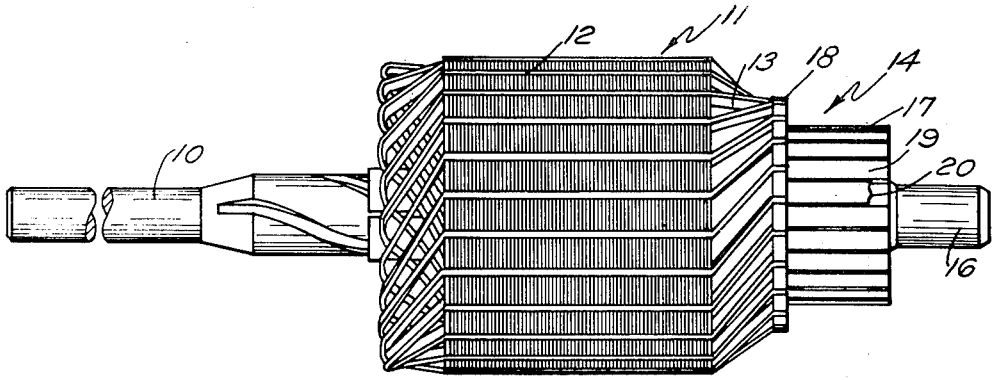
FIG. 1 is an elevation of the armature having a damaged brush-engaging portion of the commutator.
Figure 2:
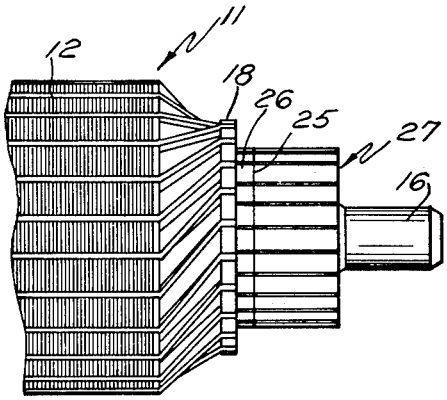
FIG. 2 is a view of a portion of the armature, particularly the commutator end, showing a severing line for cutting of a portion of the brush-engaging portion from the portion of the commutator to which the wires are connected.

In this invention, however, instead of unsoldering each of the wires from its riser portion 18, a cut 25 (see FIG. 2) is made through the brush-engaging portion at a location spaced from the riser portions 18 so as to leave a stub portion 26, this cut extending through to the shaft so as to leave the brush-engaging portion 27 free to be removed.

Figure 5:
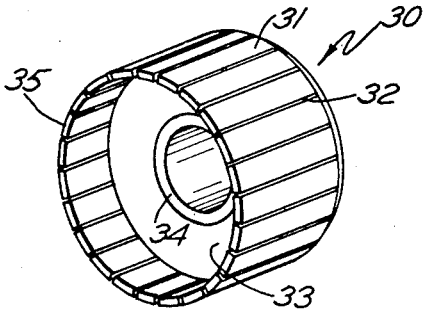
FIG. 5 is a perspective view of the replacement unit.

To replace the removed portion 27 of the commutator, a unit designated 30 (see FIG. 5) is provided having a plurality of segments 31 equal in number to the segments of the parts 27 which was removed and with the segments 31 insulated from each other by insulation 32 with an insulating sleeve 33 molded therein and with a bushing 34 extending through this insulating portion. The insulating sleeve is set inwardly from the edge 35 of the commutator segments and the inside diameter of this cup portion is of a size to fit over the stub portions 26 extending from the riser portions 18 of the heretofore installed commutator. In some cases there may be a turning down of this stub portion as shown by the dotted line 36 in FIG. 3 so as to provide a diameter of this stub portion equal to the inner diameter of extending portions 35 of the newly formed unit 30. This newly formed unit is then slipped over the shaft and fits closely on the raised portion 15 of the shaft while each of the sections of the cup portion fit closely about the stub portions 26. Thereafter, solder as designated 37 is utilized to attach these portions of the cup to each of the sections of the stub and riser portions and a new brush-engaging portion is thus formed.

Figure 6:
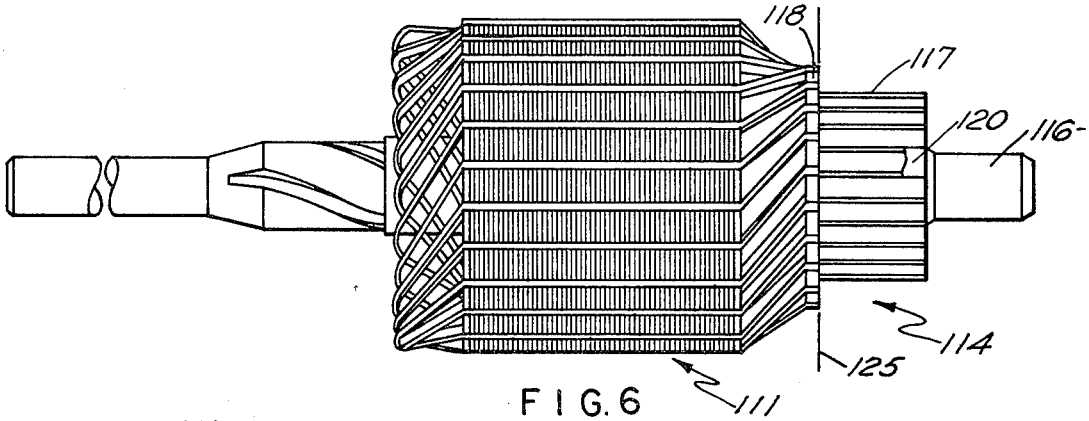
FIG. 6 is an elevational view of the armature having a damaged brush-engaging portion with a line indicating the point of severing.
Figure 7:
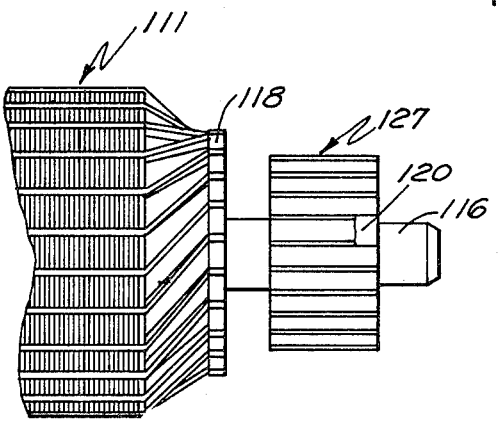
FIG. 7 is a view of a portion of the armature showing the worn commutator being severed and partially moved off the shaft.

Referring now to FIGS. 6 through 11 of the drawings in which like parts bear the same reference numerals in the 100 series, there is shown an armature core 111 of usual configuration containing coils which terminate into segments of a commutator generally designated 114. As well known in the art, the commutator has two portions, one being the brush-engaging portion 117 and the second being the riser portion designated 118 which extends at right angles to the brush-engaging portion. In accordance with this second embodiment in order to repair a damaged commutator which may have a portion of a segment as at 120 chipped out a cut is made on the line designated 125 which is immediately adjacent the riser portions 118. This cut is made through the insulating material and down to the shaft in a careful fashion, the shaft being of a much harder material than the commutator itself which is made out of generally copper and an electrically non-conductive central body. As seen in FIG. 7 the damaged commutator generally designated 127 may be slid off the shaft 116.

Figure 8:
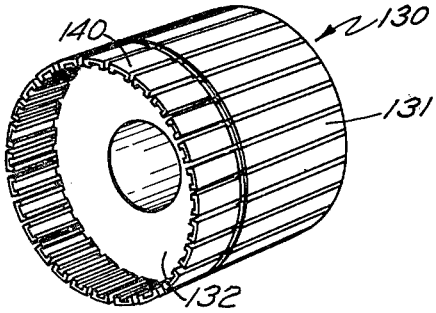
FIG. 8 is a perspective view of the replacement unit in its molded state.

Referring now to FIG. 8 a replacement unit generally designated 130 is provided with a plurality of segments 131 equal in number to the segments of the commutator 127 which was removed. Each of the segments 131 is held in position by electrical insulation 132 in a manner well known to those skilled in the art as, for example, by practicing the methods known in the prior art and illustrated in patent 2,634,495 and the electrical insulating material extends short of the end of the commutator segments.

Figure 9:
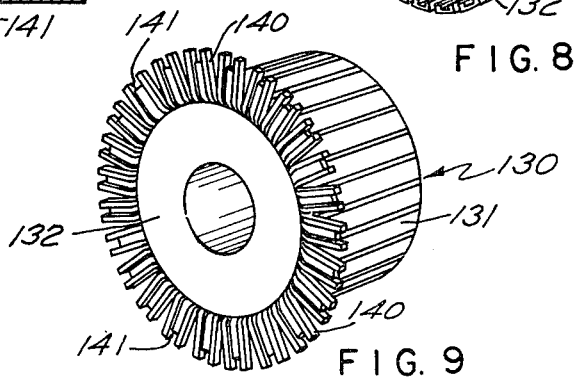
FIG. 9 is a perspective view of the molded unit with the ends bent radially outward for abutment with the riser portions.
Figure 12:
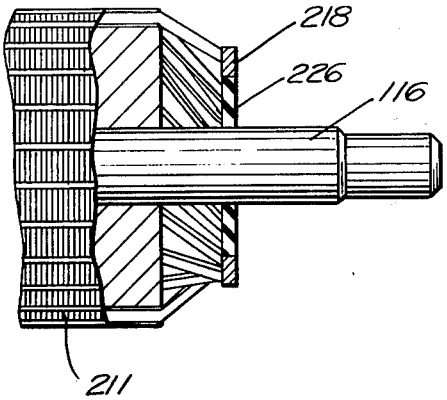
FIG. 12 is a fragmental section of an armature similar to FIG. 7 with the brush-engaging portion removed.
Figure 13:
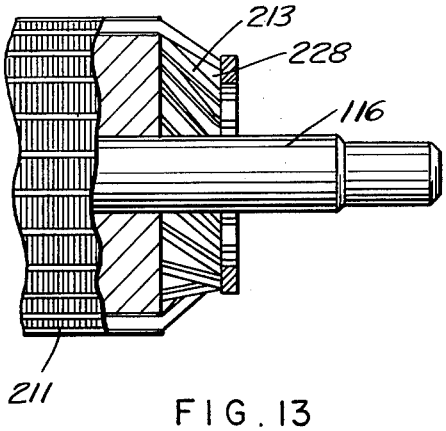
FIG. 13 is a view similar to FIG. 12 with the insulation within the riser portions removed.

The next step in the operation is to take the ends of the commutator segments such as the ends 140 as seen in FIG. 8 and bend them radially outward as seen in FIG. 9. Additionally in order to provide ease in mating these ends 140 with the riser sections 118, slots may be cut in each of the ends 140 as seen in FIG. 9.

Figure 10:
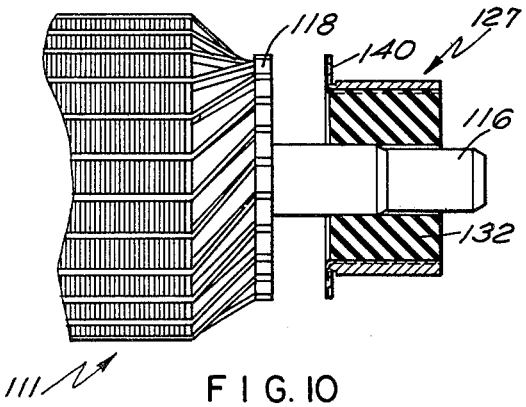
FIG. 10 is a partial elevational view showing the replacement unit being inserted onto the commutator end of the shaft.
Figure 11:
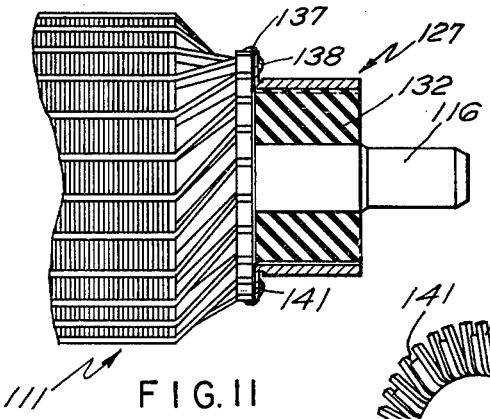
FIG. 11 is a partial elevational view showing the replacement unit in position.

This completed structure may then be inserted on the shaft 116 as seen in FIG. 10 and slid on into abutment with the riser sections 118 and lined up therewith so that if slots such as 141 are provided, these slots will align with the ends of the coils that are soldered to the riser sections. By a simple operation of placing solder such as the glob 137 seen in FIG. 11 across from the ends of the coil and into the slot 141 a permanent electrical connection will be made, and if the solder is carried down as at 138 a good mechanical as well as electrical connection will be made and the commutator will remain in place on the shaft 116.

Referring now to FIGS. 12 through 15 of the drawings in which like parts bear the same reference numerals in the 200 series, there is shown an armature core 211 of usual configuration containing coils which terminate into segments of a commutator generally designated 114 (FIG. 6). As well known in the art, the commutator has two portions, one being the brush-engaging portion 117 and the second being the riser portion designated 118 which extends at right angles to the brush-engaging portion. In accordance with this third embodiment in order to repair a damaged commutator a cut is made on the line designated 125 (FIG. 6) which is immediately adjacent the riser portions 118. This cut is made through the insulating material and down to the shaft in a careful fashion, leaving some insulation 226 (FIG. 12), the shaft being of a much harder material than the commutator itself which is made out of generally copper and an electrically non-conductive central body. As seen in FIG. 7 the damaged commutator generally designated 127 may be slid off the shaft 116.

The insulation 226 beneath the riser portion 218 (FIG. 12) is then removed opening the hollow portion 228 beneath the coil ends 213.

Figure 14:
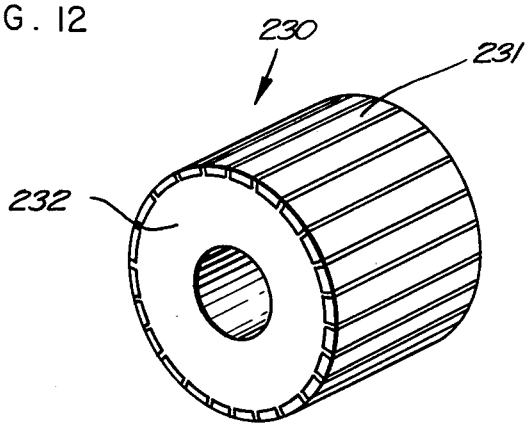
FIG. 14 is a perspective view of replacement brush-engaging portion.
Figure 15:
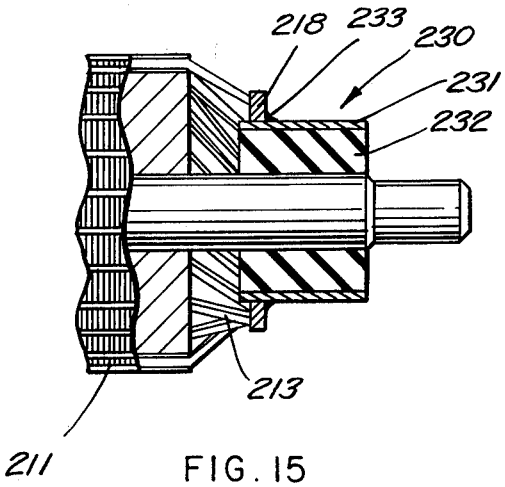
FIG. 15 is a sectional view of the replacement brush-engaging portion in position.

Referring now to FIG. 14 a replacement unit generally designated 230 is provided with a plurality of segments 231 equal in number to the segments of the commutator 127 which was removed. Each of the segments 231 is held in position by electrical insulation 232 in a manner well known to those skilled in the art as, for example, by practicing the methods known in the prior art and illustrated in U.S. Pat. No. 2,634,495 and the electrical insulating material extends to the end of the commutator segments.

The next step in the operation is to slide the replacement unit 230 over the end of the shaft with its inner end beneath and having each of its segments registering with its corresponding riser segments 218 and then soldering the corresponding segments for electrical connection as at 233.

Accordingly, a new brush-engaging portion has been easily provided by the simple steps delineated above.

I claim:

1. The method of repairing an armature wherein the armature has a commutator formed of segments with brush-engaging portions and riser portions to which the coil lead wires are connected, said segments being insulated and spaced from each other, said method including the steps of circularly severing the brush-engaging portions from the riser portions and removing said severed brush-engaging portion, forming an annulus of segments corresponding to the number of segments in the removed brush-engaging portion, positioning said annulus adjacent that part of the commutator remaining after the removing step and electrically connecting each of said annulus segments to a respective riser portion to provide a replaced brush-engaging portion of the armature.

2. The method of claim 1 wherein the brush-engaging portions are severed at a point spaced from the riser portions to leave segment stubs extending from the riser portions and wherein the annulus of segments are provided with a recess to fit over the segment stubs and telescope the annulus over the stubs.

3. The method of claim 1 wherein the annulus of segments is formed with radially outward ends for abutment with the riser portions.

4. The method of claim 1 wherein an opening is provided inwardly of the riser portions and the annulus enters said opening.

* * * * *